US010532589B2

(12) United States Patent
Yokota

(10) Patent No.: US 10,532,589 B2
(45) Date of Patent: Jan. 14, 2020

(54) PRINTING APPARATUS AND METHOD FOR CONTROLLING PRINTING

(71) Applicant: SEIKO EPSON CORPORATION, Tokyo (JP)

(72) Inventor: So Yokota, Shiojiri-shi (CN)

(73) Assignee: SEIKO EPSON CORPORATION, Tokyo (JP)

( * ) Notice: Subject to any disclaimer, the term of this patent is extended or adjusted under 35 U.S.C. 154(b) by 149 days.

(21) Appl. No.: 15/897,769

(22) Filed: Feb. 15, 2018

(65) Prior Publication Data

US 2018/0236789 A1 Aug. 23, 2018

(30) Foreign Application Priority Data

Feb. 17, 2017 (JP) ..... 2017-027620

(51) Int. Cl.

| | |
|---|---|
| ***B41J 11/00*** | (2006.01) |
| ***B41J 15/04*** | (2006.01) |
| ***B41J 2/01*** | (2006.01) |
| ***B41J 3/60*** | (2006.01) |

(52) U.S. Cl.

CPC ..... *B41J 11/0095* (2013.01); *B41J 2/01* (2013.01); *B41J 3/60* (2013.01); *B41J 11/0075* (2013.01); *B41J 15/04* (2013.01)

(58) Field of Classification Search

CPC ..... B41J 11/0095; B41J 11/0075; B41J 3/60; B41J 2/01; B41J 15/04; B41J 29/393

See application file for complete search history.

(56) References Cited

U.S. PATENT DOCUMENTS

2007/0195146 A1* 8/2007 Tanabe ..... B41J 13/103 347/104
2009/0080959 A1* 3/2009 Shiraiwa ..... B41J 13/103 400/196
2013/0201246 A1* 8/2013 Belbeck ..... B41J 3/543 347/19

FOREIGN PATENT DOCUMENTS

JP 2010-012660 A 1/2010

* cited by examiner

*Primary Examiner* — Justin Seo
(74) *Attorney, Agent, or Firm* — Foley & Lardner LLP

(57) ABSTRACT

A printing apparatus includes a printing unit that prints on a front surface of a medium, a detection unit that receives reflected light of light emitted on a back surface of the medium, and a control unit that stops printing based on a detection result of the detection unit. In a case in which a second image is to be printed on the front surface of the medium of which back surface a first image being printed, when a range in which the first image is printed on the back surface of the medium is defined as a first range and a range corresponding to the first range on the front surface of the medium is defined as a second range, when printing the second image in the second range, the control unit continues printing irrespective of the detection result of the detection unit.

5 Claims, 7 Drawing Sheets

PRINTING APPARATUS AND METHOD FOR CONTROLLING PRINTING

BACKGROUND

1. Technical Field

The present invention relates to a printing apparatus and a method for controlling printing.

2. Related Art

JP-A-2010-12660 discloses a printer as an example of a printing apparatus which includes a recording head which prints on a rolled sheet, a transport guide unit which constitutes a path through which the rolled sheet passes toward the recording head, and a paper end sensor which detects whether a rolled sheet exists in the transport guide unit.

This printing apparatus stops printing when it is detected that no rolled sheet exists in the transport guide unit based on a detection result of the paper end sensor. Subsequently, the printing apparatus notifies a user to replace the rolled sheet and keeps the apparatus in a stopped state until replacement of the rolled sheet finishes.

The above-described printing apparatus determines whether a rolled sheet exists in a transport guide unit depending on existence of reflected light when a paper end sensor emits light in a detection area provided in the transport guide unit. Therefore, if reflectance in a portion in which an image of a back surface of a rolled sheet is printed during double-sided printing (an image is to be printed on a front surface of the rolled sheet of which an image has been printed on the back surface thereof) is low, there is a possibility that the paper end sensor cannot detect the reflected light. In this case, it is incorrectly determined that no rolled sheet (printing target) exists though a rolled sheet actually exists in the transport guide unit, and printing may be stopped.

SUMMARY

An advantage of some aspects of the invention is to provide a printing apparatus that can reduce stopping printing following incorrect determination of an end of a medium (a printing target).

Hereinafter, means, operations and effects for solving the above problem will be described. A printing apparatus according to an aspect of the invention includes a transport unit that transports a medium in a transport direction, a printing unit that prints on a front surface of the medium transported by the transport unit, a detection unit that receives reflected light of light emitted on a back surface of the medium transported in a detecting position located upstream of the printing unit in the transport direction on a transport path of the medium, and a control unit that stops printing based on a detection result of the detection unit when an end of the medium in the transport direction reaches the detecting position. In a case in which a second image is to be printed on the front surface of the medium of which back surface a first image being printed, when a range in which the first image is printed on the back surface of the medium is defined as a first range and a range corresponding to the first range on the front surface of the medium is defined as a second range, the control unit continues printing irrespective of the detection result of the detection unit when printing the second image in the second range.

According to the above configuration, when the second image is to be printed in the second range on the front surface of the medium corresponding to the first range on the back surface of the medium, the printing apparatus continues printing irrespective of the detection result of the detection unit. Therefore, since the detection unit emits light on the first image printed on the back surface, it can be reduced that the control unit stops printing when the reflected light cannot be detected. Therefore, stop of printing following incorrect determination of the end of the medium can be reduced.

In the above printing apparatus, it is desirable that the control unit determines the second range in accordance with the length of the first image in the transport direction. According to the above configuration, since the control unit determines the second range in accordance with the length of the first image in the transport direction, control load of the control unit can be reduced.

It is desirable that the above printing apparatus further includes a second detection unit that detects a pattern formed in a position downstream of the first image in the transport direction on the back surface of the medium when the detection unit is defined as a first detection unit. In the above printing apparatus, it is desirable that the control unit determines the second range based on a detection result of the second detection unit.

If the control unit determines the second range based on the detection result when the second detection unit detects the first image, there is a possibility that reflectance of the first image may affect detecting accuracy of the second detection unit. In this regard, according to the above configuration, the control unit determines the second range based on the detection result of the dedicated pattern for detecting the position in which the first image is printed. Therefore, the control unit can precisely determine the second range.

A method for controlling printing according to another aspect of the invention in which, in a printing apparatus including a transport unit that transports a medium in a transport direction, a printing unit that prints on a front surface of the medium transported by the transport unit, and a detection unit that receives reflected light of light emitted on a back surface of the medium transported in a detecting position located upstream of the printing unit in the transport direction on a transport path of the medium, printing is stopped based on a detection result of the detection unit when an end of the medium in the transport direction reaches the detecting position, wherein in a case in which a second image is to be printed on the front surface of the medium of which back surface a first image being printed, when a range in which the first image is printed on the back surface of the medium is defined as a first range and a range corresponding to the first range on the front surface of the medium is defined as a second range, printing is continued irrespective of the detection result of the detection unit when printing the second image in the second range.

According to the above configuration, the same effect as that of the printing apparatus described above can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a printing apparatus will be described with reference to the drawings. The printing apparatus of the present embodiment is an ink jet printer which prints an image by ejecting ink on a medium, such as a paper sheet unrolled from a rolled sheet. Here, "image" includes text, sign, and the like.

Figure 1:
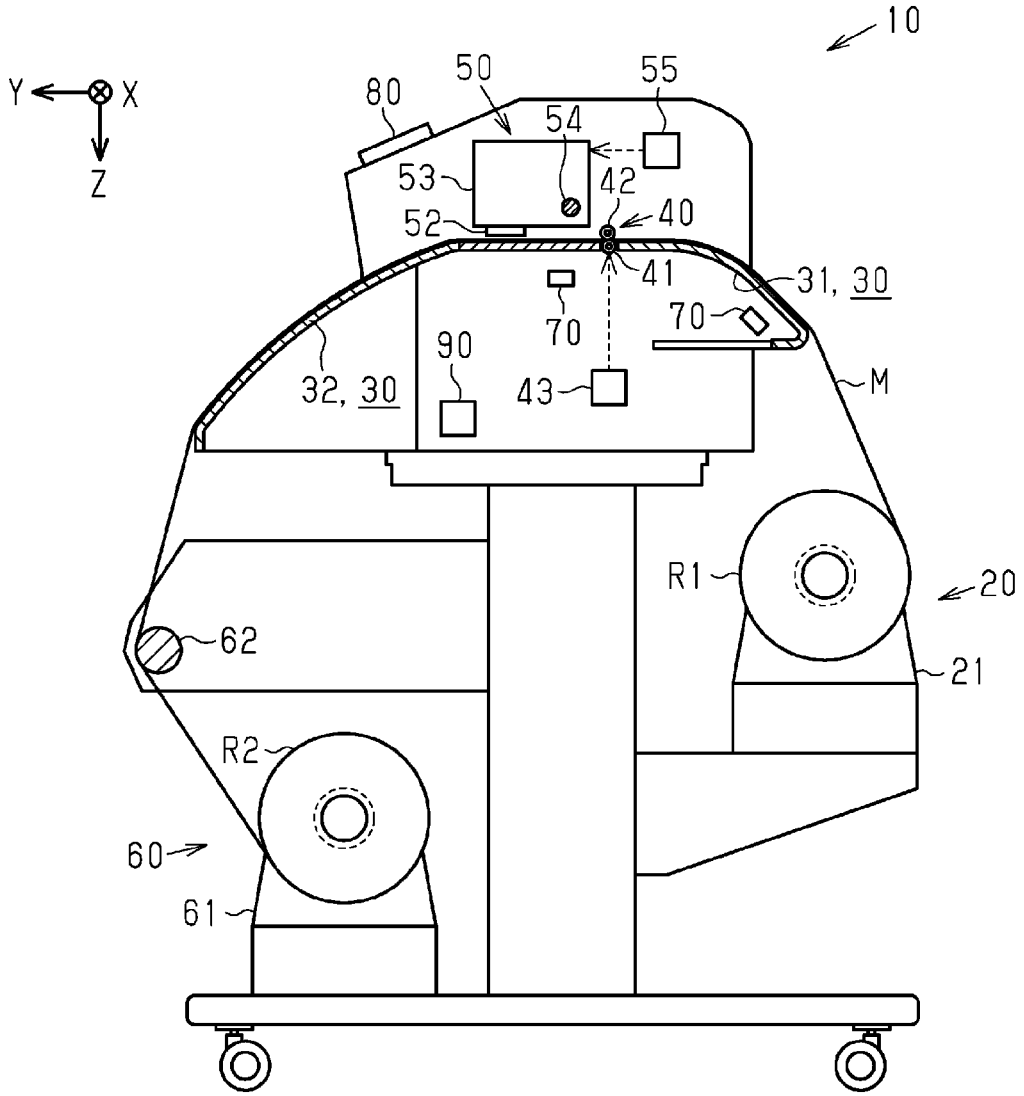
FIG. 1 is a schematic side view illustrating a configuration of a printing apparatus according to an embodiment.

As illustrated in FIG. 1, a printing apparatus 10 includes a sending unit 20 which sends a medium M (which is wound in a roll shape) in a transport direction of the medium M, a support portion 30 which supports the medium M, a transport unit 40 which transports the medium M, a printing unit 50 which prints on the medium M, and a take-up unit 60 which takes the medium M up. The printing apparatus 10 further includes a detection mechanism 70 which detects the medium M on a transport path, an operation unit 80 to be operated by a user (an operator), and a control unit 90 which controls driving of constituting members of the printing apparatus 10.

In the following description, a width direction of the printing apparatus 10 is defined as a "width direction X," a depth direction is defined as a "front/rear direction Y," and a height direction is defined as a "vertical direction Z." In the present embodiment, the width direction X, the front/rear direction Y direction, and the vertical direction Z are mutually different (orthogonally crossing) directions.

As illustrated in FIG. 1, the sending unit 20 includes a holding portion 21 which removably keeps a roll body R1 which is the medium M wound in a rolled shape. The sending unit 20 sends out the medium M (which is unrolled from the roll body R1) by rotating the roll body R1 in one direction (counterclockwise in FIG. 1).

The transport unit 40 includes a driving roller 41 disposed at the lower part of the transport path of the medium M, a driven roller 42 disposed at the upper part of the transport path of the medium M, and a transport motor 43 which drives the driving roller 41. The driving roller 41 and the driven roller 42 are rollers which rotate with the width direction X as a rotation shaft direction. The transport unit 40 transports the medium M sent out of the sending unit 20 in the transport direction by driving the transport motor 43 with the medium M being pinched between the driving roller 41 and the driven roller 42.

Figure 2:
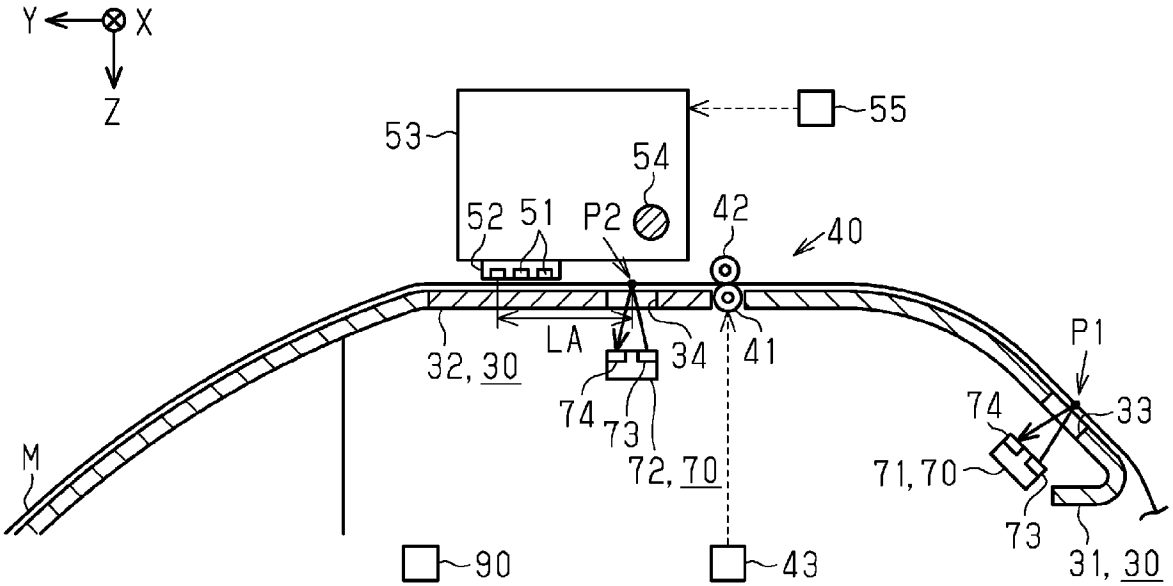
FIG. 2 is an enlarged side view of the printing apparatus.

As illustrated in FIGS. 1 and 2, the support portion 30 includes a first support portion 31 disposed upstream in the transport direction, and a second support portion 32 disposed downstream in the transport direction. The first support portion 31 and the second support portion 32 are planar support portions of which longitudinal directions correspond to the width direction X and of which short directions correspond to the transport direction of the medium M. The first support portion 31 is disposed upstream of the transport unit 40 in the transport direction, and the second support portion 32 is disposed downstream of the transport unit 40 in the transport direction.

As illustrated in FIG. 2, a first opening 33 is formed to penetrate the first support portion 31 so that a back surface of the medium M which is transported on the first support portion 31 is exposed to the back side (inside) of the first support portion 31. Similarly, a second opening 34 is formed to penetrate the second support portion 32 so that a back surface of the medium M which is transported on the second support portion 32 is exposed to the back side (inside) of the second support portion 32.

In the printing apparatus 10 in which the medium M is transported along the width direction center of the support portion 30, the first opening 33 is desirably formed at the width direction center of the first support portion 31, and the second opening 34 is desirably formed at the width direction center of the second support portion 32. In the printing apparatus 10 in which the medium M is transported along the width direction one side of the support portion 30, the first opening 33 is desirably formed at the width direction one side of the first support portion 31, and the second opening 34 is desirably formed at the width direction one side of the second support portion 32. That is, the first opening 33 and the second opening 34 desirably open toward the transport path of the medium M.

As illustrated in FIGS. 1 and 2, the printing unit 50 includes an ejecting unit 52 in which nozzles 51 through which the ink is ejected are formed, and a carriage 53 which supports the ejecting unit 52. The printing unit 50 further includes a guide shaft 54 which supports the carriage 53 in a reciprocating manner in the width direction X, and a moving mechanism 55 which makes the carriage 53 reciprocate in an axial direction of the guide shaft 54 (the width direction X).

The ejecting unit 52 is supported on a lower surface of the carriage 53. The ejecting unit 52 has a plurality of nozzles 51 which eject different types of inks (for example, cyan ink, magenta, yellow, and black inks) to the support portion 30. In the ejecting unit 52, a nozzle array is constituted by a plurality of nozzles 51 which ejects the same type of ink aligned in the direction which crosses the width direction X (for example, the transport direction of the medium M).

In the printing unit 50, the moving mechanism 55 moves the carriage 53 in the width direction X based on a print command from a user, and the like. When the carriage 53 is moved in the width direction X, the ejecting unit 52 ejects the ink to the medium M supported by the support portion 30. In this manner, the printing unit 50 prints an image on the surface of the medium M.

As illustrated in FIG. 1, the take-up unit 60 includes a holding portion 61 which removably holds the roll body R2 which is the medium M wound in a rolled shape, and a tension bar 62 which applies tension to the medium M in the direction which crosses the transport direction. The take-up unit 60 takes up the medium M wound around the tension bar 62 by rotating the roll body R2 in one direction (counterclockwise in FIG. 1).

As illustrated in FIG. 2, the detection mechanism 70 includes a first detection unit 71 as an example of a "detection unit" disposed on the back side of the first support portion 31, and a second detection unit 72 disposed on the back side of the second support portion 32.

The first detection unit 71 includes a light projection unit 73 which emits light toward the transport path of the medium M via the first opening 33, and a light receiving unit 74 which receives the light incident via the first opening 33 from the transport path of the medium M. The first detection unit 71 outputs a signal in accordance with intensity of the reflected light received by the light receiving unit 74. Similarly, the second detection unit 72 includes a light projection unit 73 which emits light toward the transport path of the medium M via the second opening 34, and a light receiving unit 74 which receives the light incident via the second opening 34 from the transport path of the medium M. The second detection unit 72 outputs a signal in accordance with intensity of the reflected light received by the light receiving unit 74.

That is, the first detection unit 71 and the second detection unit 72 may desirably be reflective optical sensors. The light to be detected by the first detection unit 71 and the second detection unit 72 may be visible light or infrared light.

In the following description, a detecting position of the first detection unit 71 is referred to as a "first detecting position P1" and a detecting position of the second detection unit 72 is referred to as a "second detecting position P2." In the transport path of the medium M, the first detecting position P1 is located downstream of the sending unit 20 in the transport direction and upstream of the printing unit 50 (the transport unit 40) in the transport direction. The second detecting position P2 is located downstream of the transport unit 40 in the transport direction and upstream of the printing unit 50 in the transport direction.

In the transport direction, a distance between the nozzle 51 on the most downstream side of the ejecting unit 52 and the second detecting position P2 is defined as the "reference distance LA." The reference distance LA is the distance determined by the design of the printing apparatus 10.

Next, the control unit 90 will be described. The first detection unit 71, the second detection unit 72, and the operation unit 80 are connected to an input side interface of the control unit 90. The sending unit 20, the transport unit 40 (the transport motor 43), the printing unit 50 (the ejecting unit 52 and the moving mechanism 55), and the take-up unit 60 are connected to an output side interface of the control unit 90.

The control unit 90 executes print processing in accordance with a print job transmitted from a computer or the like connected to the printing apparatus 10. Specifically, the control unit 90 controls the sending unit 20, the transport unit 40, and the take-up unit 60, and executes transport processing to transport the medium M in the transport direction. The control unit 90 controls the ejecting unit 52 and the moving mechanism 55, and executes ejection processing to eject the ink toward the medium M from the ejecting unit 52 while moving the carriage 53 in the width direction X. The control unit 90 then alternately executes the transport processing and the ejection processing, and executes print processing to print an image on the medium M. The print job is data including information about an image to be printed on the medium M and information about a method for printing.

The control unit 90 determines whether the medium M transported in the transport direction exists in accordance with the detection result of the first detection unit 71. Specifically, if the medium M blocks the first opening 33 (that is, if the medium M exists on the first detecting position P1), the first detection unit 71 receives the reflected light of the light emitted to the first detecting position P1. If the medium M does not block the first opening 33, that is, if the medium M does not exist in the first detecting position P1, the first detection unit 71 does not receive the reflected light of the light emitted to the first detecting position P1. In this manner, the first detection unit 71 outputs signals of different intensities depending on whether the medium M exists in the first detecting position P1.

The control unit 90 determines whether the medium M exists in the first detecting position P1 based on the difference in the signal intensity input from the first detection unit 71. When a state in which the medium M is determined to exist in the first detecting position P1 is shifted to a state in which the medium M is determined not to exist in the first detecting position P1, the control unit 90 determines that the end of the medium M has reached the first detecting position P1.

The control unit 90 stops print processing when it determines that the end of the medium M has reached the first detecting position P1. In this manner, ejection of the ink to the support portion 30 not supporting the medium M though the medium M (an ejecting target of the ink) does not actually exist is reduced. The control unit 90 may immediately stop print processing when it determines that the end of the medium M has reached the first detecting position P1, or may stop print processing until the end of the medium M reaches the printing unit 50 or the transport unit 40. In the following description, processing to stop printing when the control unit 90 determines that the end of the medium M has reached the first detecting position P1 is referred to as "termination processing."

The control unit 90 executes print processing for "single-sided printing" in which an image is printed on the front surface of the medium M with no image printed on the back surface, and print processing for "double-sided printing" in which an image is printed on the front surface of the medium M with an image being printed on the back surface.

Figure 3:
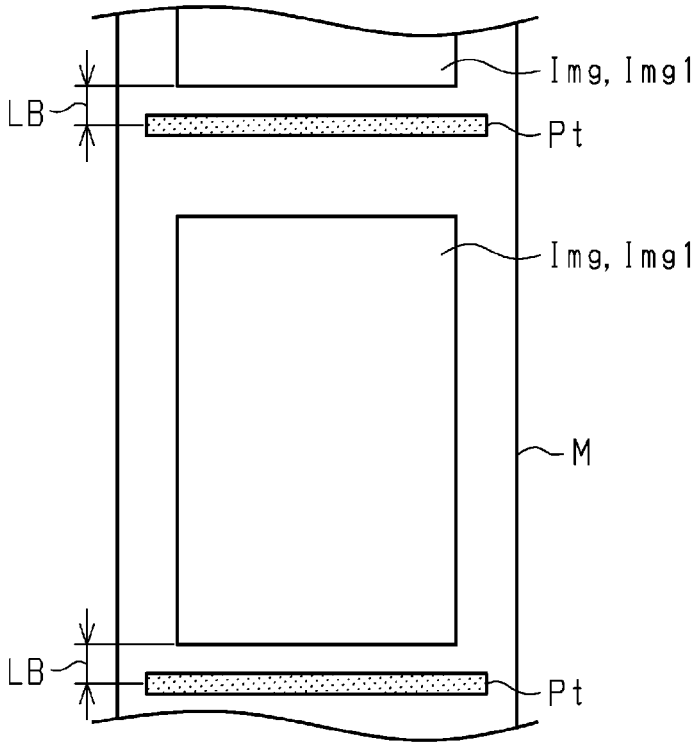
FIG. 3 is a plan view of a medium on which an image has been printed on one surface thereof.

As illustrated in FIG. 3, for single-sided printing, the control unit 90 prints a pattern Pt before printing an image Img. Specifically, for single-sided printing, the control unit 90 prints the pattern Pt upstream of a position in which the image Img is to be printed with respect to the medium M in the transport direction. The pattern Pt indicates that the image Img is printed in a position shifted by a print interval LB in the transport direction downstream of the position in which the pattern Pt is printed. The pattern Pt may desirably be in a form readable by the second detection unit 72. In the present embodiment, for the ease of description, the pattern Pt is a straight line of a color different from that of the medium M and a longitudinal direction of the pattern Pt corresponds to the width direction X.

For double-sided printing, the control unit 90 may print, on the front surface of the medium M, an image corresponding to an image to be printed on the back surface of the medium M. For example, an image to be printed on the front surface of the medium M may be the same image as the image printed on the back surface of the medium M or an image of the same size as that of the image printed on the back surface of the medium M. A printed matter obtained by double-sided printing may be a tapestry, a banner, and a window display of which images can be seen from both sides thereof.

Here, in double-sided printing, an image printed on the back surface is defined as a "first image Img1" and an image printed on the front surface is defined as a "second image Img2." A range in which the first image Img1 is printed on the back surface is defined as a "first range Ra" and a range corresponding to the first range Ra on the front surface is defined as a "second range Rb." In a plan view of the medium M, the first range Ra and the second range Rb overlap each other.

When defined in this manner, in double-sided printing, if the first image Img1 and the second image Img2 are correlated, the second image Img2 is printed in the second range Rb. That is, the control unit 90 prints the second image Img2 in the second range Rb corresponding to the first range Ra in accordance with the detection result of the second detection unit 72.

Specifically, for double-sided printing, the control unit 90 acquires a position in which the first image Img1 is printed upon detection of the pattern Pt printed on the back surface of the medium M by the second detection unit 72. Then, the control unit 90 sets a position of the medium M transported a distance corresponding to the sum of the reference distance LA and the print interval LB from the second detecting position P2 of the pattern Pt to be a print start position of the second image Img2. As a result, the second image Img2 will be printed in the second range Rb corresponding to the first range Ra in which the first image Img1 has been printed. In the present embodiment, the first range Ra and the second range Rb are ranges in the transport direction.

When the second image Img2 is longer than the first image Img1 in the transport direction, the control unit 90 stops print processing in the same manner as in single-sided printing. Specifically, in a case in which the print length of the second image Img2 is longer than the length of the first image Img1 (=the lengths of the ranges Ra and Rb) in the transport direction, the control unit 90 stops print processing of the second image Img2. Here, the "case" refers to, for example, a case in which a print job for printing an image unrelated to the first image Img1 is input into the printing apparatus 10, or a case in which the roll body R1 which is the wound medium M on which the first image Img1 unrelated to the second image Img2 has been printed on the back surface thereof is set to the sending unit 20.

In the printing apparatus 10 of the present embodiment, when double-sided printing is to be performed, the image printed on the back surface of the medium M (the first image Img1) may be positioned in the first detecting position P1. In this case, if an image which does not reflect light easily (for example, a black image) is positioned in the first detecting position P1, light emitted from the first detection unit 71 is not easily reflected. As a result, there is a possibility that the control unit 90 may incorrectly determine that the end of the medium M has reached the first detecting position P1 though the medium M actually exists in the first detecting position P1.

Then, in the present embodiment, for double-sided printing, when printing the second image Img2 in the second range Rb, the control unit 90 continues printing irrespective of the detection result of the first detection unit 71. That is, when the second image Img2 is to be printed on the front surface of the medium M in accordance with the print start position of the first image Img1 printed on the back surface of the medium M, the control unit 90 does not stop printing as long as the second image Img2 is to be printed in a range corresponding to a print length of the first image Img1 in the transport direction.

When the control unit 90 prints the second image Img2 in the second range Rb, detection of the first detection unit 71 itself may not be performed, or the detection result of the first detection unit 71 may not be used while detection itself from the first detection unit 71 may be defined as valid.

Figure 4:
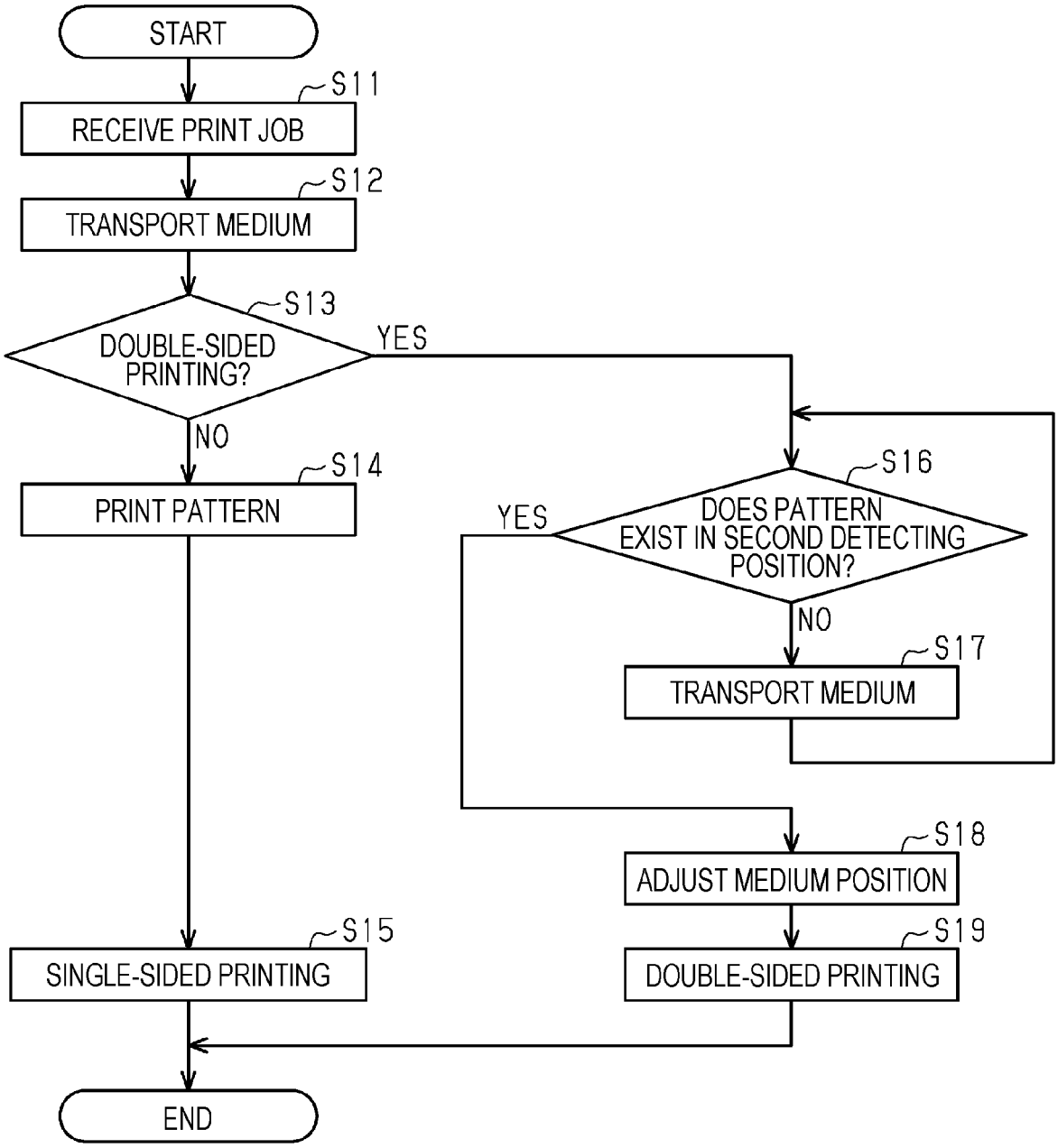
FIG. 4 is a flowchart illustrating a process content to be executed by a control unit upon reception of a print job.

Next, a process flow (a method for controlling printing) to be executed by the control unit 90 when a print job is submitted will be described with reference to a flowchart of FIG. 4. As illustrated in FIG. 4, the control unit 90 receives a print job transmitted from an unillustrated computer or the like connected to the printing apparatus 10 (step S11). The control unit 90 causes the medium M to be transported in the transport direction until the medium M reaches a position in which the ejecting unit 52 can eject the ink (step S12). Then, the control unit 90 determines whether double-sided printing is to be performed based on the contents of the print job (step S13). If single-sided printing is to be performed (step S13: NO), the control unit 90 executes print processing for printing the pattern Pt (step S14). Then, the control unit 90 executes print processing for performing single-sided printing (step S15) and temporarily terminates this processing.

In the precedent step S13, if double-sided printing is to be performed (step S13: YES), the control unit 90 determines whether the pattern Pt exists in the second detecting position P2 based on the detection result of the second detection unit 72 (step S16). If no pattern Pt exists in the second detecting position P2 (step S16: NO), the control unit 90 transports the medium M a prescribed amount (step S17), and proceeds the process to the precedent process (step S16). If the pattern Pt exists in the second detecting position P2 (step S16: YES), the control unit 90 adjusts the position of the medium M in the transport direction (step S18). That is, the control unit 90 causes the medium M to be transported such that a print start position of the first image Img1 (a downstream end of the first range Ra) overlaps the nozzle 51 on the upstream side of the ejection head in the transport direction. The transport amount of the medium M in step S18 is a sum of the distance of the printing interval LB and the reference distance LA. Then, the control unit 90 executes print processing for performing double-sided printing (step S19), and temporarily terminates this processing.

Figure 5:
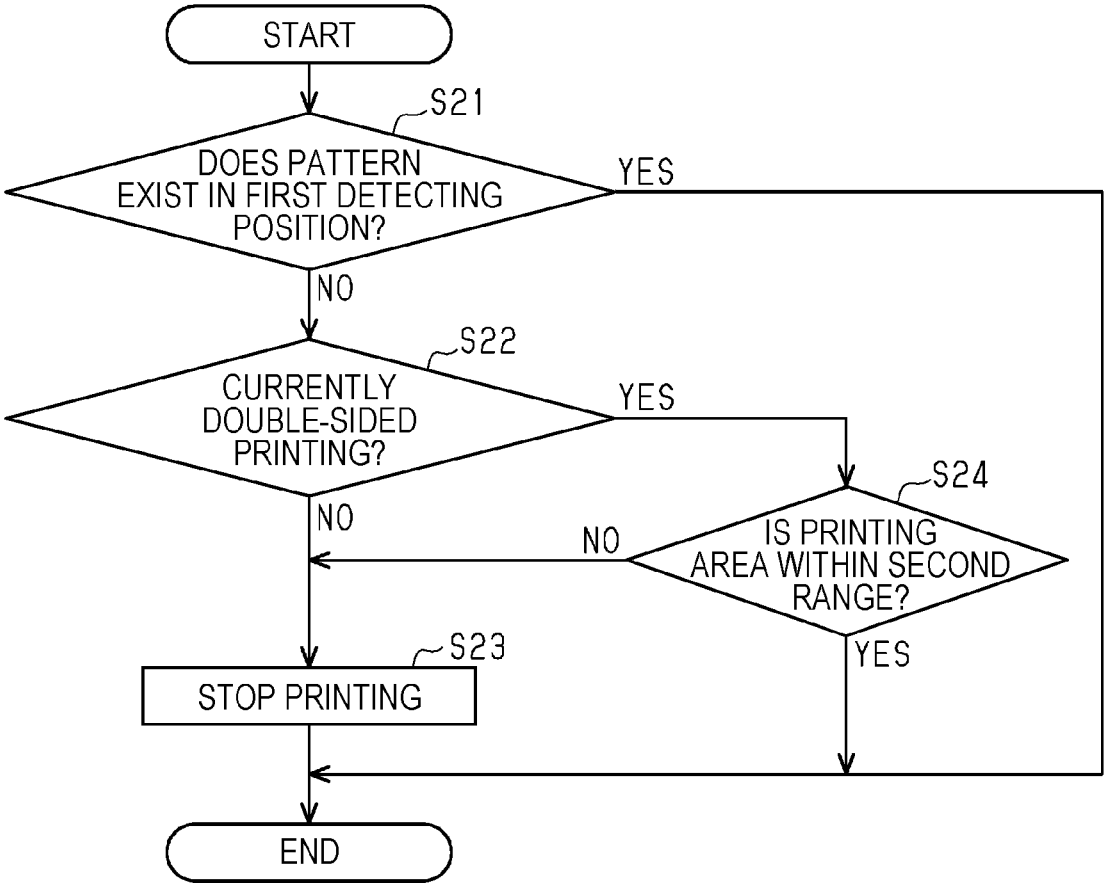
FIG. 5 is a flowchart illustrating a process content to be executed by the control unit during printing.

Next, a process flow (a method for controlling printing) to be executed by the control unit 90 when print processing for single-sided printing or double-sided printing is to be executed will be described with reference to a flowchart of FIG. 5. As illustrated in FIG. 5, the control unit 90 determines whether medium M exists in first detecting position P1 based on detection result of first detection unit 71 (step S21). When the control unit 90 determines that the medium M exists in the first detecting position P1 (step S21: YES), the control unit 90 temporarily terminates this processing. That is, in this case, printing is continued irrespective of the contents of the printing.

When the control unit 90 determines that no medium M exists in the first detecting position P1 (step S21: NO), the control unit 90 determines whether double-sided printing is being performed (step S22). When the control unit 90 determines that single-sided printing is being performed (step S22: NO), the control unit 90 executes termination processing to stop printing (step S23).

In step S22, if double-sided printing is being performed (step S22: YES), the control unit 90 determines whether a printing area of the second image Img2 is within the second range Rb. When the printing area of the second image Img2 is within the second range Rb (step S24: YES), the control unit 90 temporarily terminates this processing. In this case, since a possibility that the detection result of the first detection unit 71 is incorrect is high, print processing is continued.

If the printing area of the second image Img2 is no more within the second range Rb (step S24: NO), the control unit 90 proceeds the process to the precedent step S23. In this case, since a possibility that the detection result of the first detection unit 71 is incorrect is low, print processing is stopped.

In the present embodiment, the control unit 90 may determine whether the medium M exists in the first detecting position P1 based on the detection result of the first detection unit 71 when the medium M is to be transported in the transport direction. That is, even in a case in which the medium M is to be transported irrespective of printing, the control unit 90 may determine whether the end of the medium M has reached the first detecting position P1.

Figure 6:
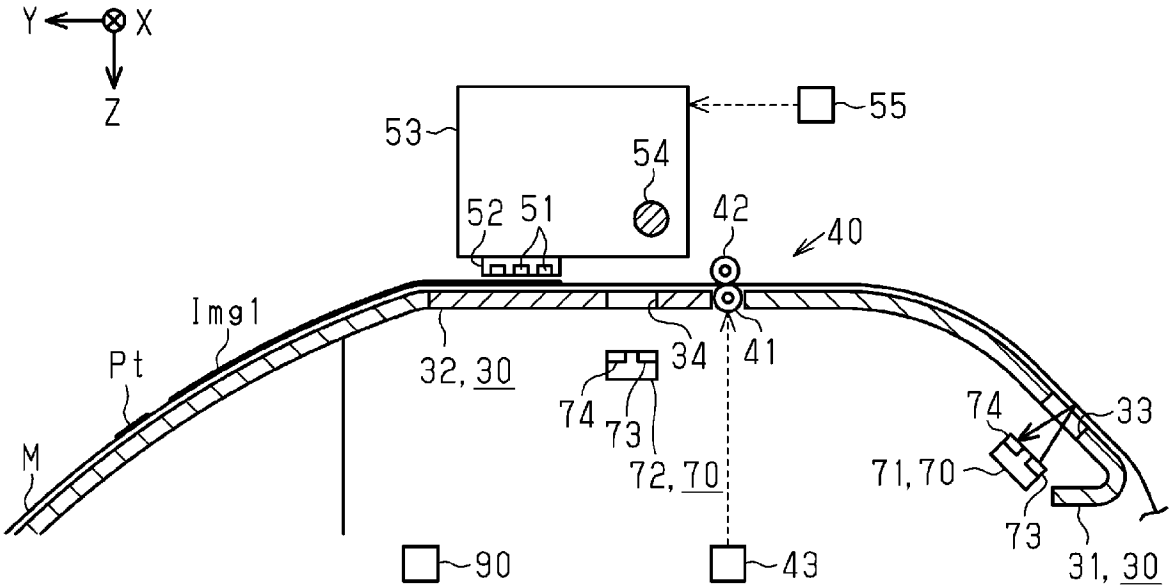
FIG. 6 is a side view illustrating an operation of the printing apparatus.

Next, an operation of the printing apparatus 10 of the present embodiment will be described with reference to FIG. 6 and FIG. 7. As illustrated in FIG. 6, during single-sided printing, the pattern Pt and an image (the first image Img1) are printed on the first surface of the medium M. Printing of the image is stopped when it is determined that the end of the medium M has reached the first detecting position P1 during printing of the first image Img1.

Figure 7:
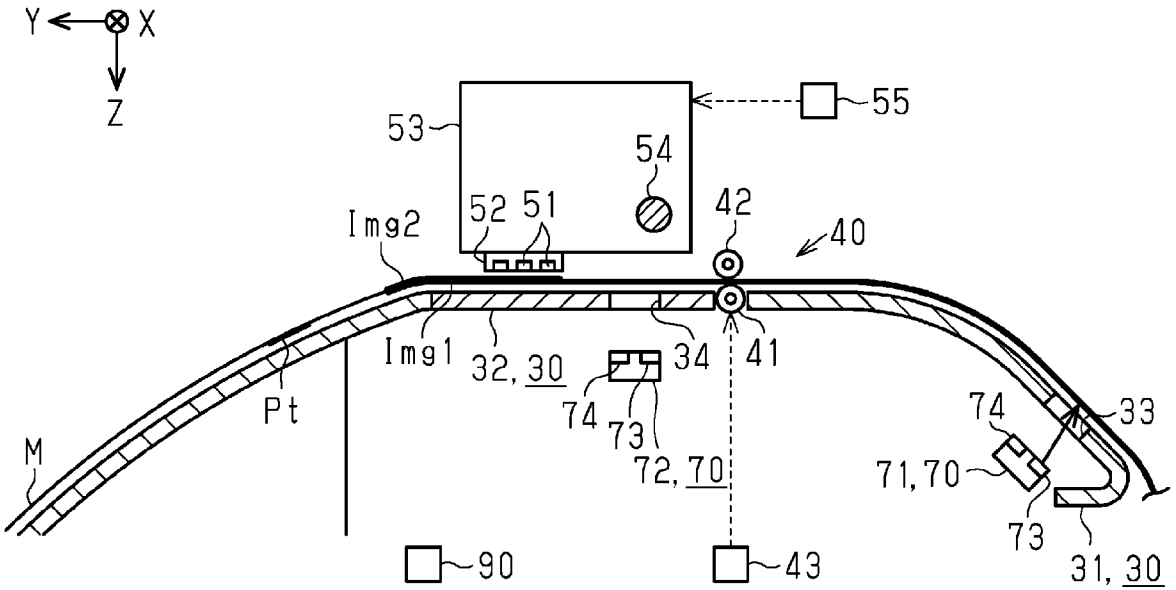
FIG. 7 is a side view illustrating an operation of the printing apparatus.

As illustrated in FIG. 7, during double-sided printing, the medium M is transported such that the first image Img1 printed on the back surface and the print start position in the transport direction are aligned based on the pattern Pt printed on the back surface. Further, the second image Img2 is printed so as to overlap the first image Img1 on the front surfaces of the medium M. Here, printing of the image is not stopped when it is determined that the end of the medium M has reached the first detecting position P1 during printing of the second image Img2. That is, as illustrated in FIG. 7, since the light emitted from the first detection unit 71 is absorbed by the first image Img1, printing of the image is not stopped even if the first detection unit 71 cannot receive the reflected light.

When the end of the medium M reaches the first detecting position P1 after termination of printing of the second image Img2, the printing apparatus 10 stops transport of the medium M or notifies the user (the operator) to replace the roll body R1 in the sending unit 20.

According to the above embodiment, the following effects can be obtained.

(1) When the second image Img2 is to be printed in the second range Rb on the front surface of the medium M corresponding to the first range Ra on the back surface of the medium M, the printing apparatus 10 continues printing irrespective of the detection result of the first detection unit 71. Therefore, since the first detection unit 71 emits light on the first image Img1 printed on the back surface, it can be reduced that the control unit 90 stops printing when the reflected light cannot be detected. Therefore, stop of printing following incorrect determination of the end of the medium M can be reduced.

(2) Since the first range Ra is determined in accordance with the length of the first image Img1 in the transport direction, control load of the control unit 90 can be reduced.

(3) For example, if a configuration in which a print start range of the first image Img1 is to be detected when the second detection unit 72 detects the first image Img1 is employed, there is a possibility that reflectance of the first image Img1 may affect detecting accuracy of the second detection unit 72. In this regard, in the present embodiment, the control unit 90 determines the second range Rb based on the detection result of the dedicated pattern Pt for detecting the position in which the first image Img1 is printed. Therefore, the control unit 90 can precisely determine the second range Rb.

The above embodiment may be changed as follows. If it is obvious that the first image Img1 and the second image Img2 which are correlated are to be printed in double-sided printing, the control unit 90 may omit execution of the process of step S24. If it is obvious that the second image Img2 which is not correlated with the first image Img1 is to be printed during double-sided printing, a process for warning a user may be executed without starting printing.

The control unit 90 may not acquire the length of the first range Ra of the first image Img1 based on the contents of the print job. For example, the control unit 90 may acquire the length of the first range Ra based on information input by the user via the operation unit 80, or based on a detection result of other detection unit. When information about the length of the first range Ra is embedded on the pattern Pt, the control unit 90 may acquire the length of the first range Ra based on the detection result of the second detection unit 72 during printing the second image Img2.

The printing apparatus 10 may not print the pattern Pt during single-sided printing which is not based on the premise that double-sided printing will be performed. The pattern Pt which indicates the print start position of the first image Img1 printed on the back surface may be a one-dimensional bar code constituted by a plurality of bars arranged in the transport direction of which longitudinal directions correspond to the width direction X and the short directions correspond to the transport direction. Alternatively, the pattern Pt may be a two-dimensional bar code which extends in the transport direction and the width direction X.

The second detection unit 72 may be provided downstream of the ejecting unit 52 in the transport direction depending on the length of the print interval LB which is the distance between the pattern Pt and the first image Img1. The printing apparatus 10 may be a printer which prints an image on cut sheets.

The printing apparatus 10 is not limited to a printer which prints an image by ejecting the ink. The printing apparatus 10 may be nonimpact printers, such as a laser printer, an LED printer, and a thermal transfer printer (a sublimation type printer), or impact printers, such as a dot impact printer.

This application claims priority under 35 U.S.C. § 119 to Japanese Patent Application No. 2017-027620, filed Feb. 17 2017. The entire disclosure of Japanese Patent Application No. 2017-027620 is hereby incorporated herein by reference.

What is claimed is:

1. A printing apparatus comprising:

a transport unit configured to transport a medium in a transport direction;

a printing unit configured to print on a front surface of the medium transported by the transport unit;

a detection unit configured to receive reflected light of light emitted on a back surface of the medium transported in a detecting position located upstream of the printing unit in the transport direction on a transport path of the medium; and a control unit configured to stop printing based on a detection result of the detection unit when an end of the medium in the transport direction reaches the detecting position, wherein the control unit is configured such that, in a case in which a second image is to be printed on the front surface of the medium of which back surface a first image being printed, when a range in which the first image is printed on the back surface of the medium is defined as a first range and a range corresponding to the first range on the front surface of the medium is defined as a second range, the control unit continues printing irrespective of the detection result of the detection unit when printing the second image in the second range.

2. The printing apparatus according to claim 1, wherein the control unit is configured to determine the second range in accordance with the length of the first image in the transport direction.

3. The printing apparatus according to claim 1, further comprising:

a second detection unit configured to detect a pattern formed in a position downstream of the first image in the transport direction on the back surface of the medium when the detection unit is defined as a first detection unit, wherein the control unit determines the second range based on a detection result of the second detection unit.

4. The printing apparatus according to claim 2, further comprising:

a second detection unit configured to detect a pattern formed in a position downstream of the first image in the transport direction on the back surface of the medium when the detection unit is defined as a first detection unit, wherein the control unit determines the second range based on a detection result of the second detection unit.

5. A method for controlling printing comprising:

providing a printing apparatus comprising:

a transport unit configured to transport a medium in a transport direction, a printing unit configured to print on a front surface of the medium transported by the transport unit, and a detection unit configured to receive reflected light of light emitted on a back surface of the medium transported in a detecting position located upstream of the printing unit in the transport direction on a transport path of the medium, stopping printing based on a detection result of the detection unit when an end of the medium in the transport direction reaches the detecting position, except, in a case in which a second image is to be printed on the front surface of the medium of which back surface a first image being printed, when a range in which the first image is printed on the back surface of the medium is defined as a first range and a range corresponding to the first range on the front surface of the medium is defined as a second range, printing is continued irrespective of the detection result of the detection unit when printing the second image in the second range.

* * * * *